US005285181A

United States Patent [19]

Laskaris et al.

[11] Patent Number: 5,285,181

[45] Date of Patent: Feb. 8, 1994

[54] SUPERCONDUCTING WINDING AND SUPPORT STRUCTURE

[75] Inventors: Evangelos T. Laskaris, Schenectady; Ahmed K. Kalafala, Albany, both of N.Y.

[73] Assignee: General Electric Company, Schenectady, N.Y.

[21] Appl. No.: 923,682

[22] Filed: Aug. 3, 1992

[51] Int. Cl.[5] ..... H01F 1/00

[52] U.S. Cl. ..... 335/216; 174/125.1

[58] Field of Search ..... 335/216, 299; 174/125.1

[56] References Cited

U.S. PATENT DOCUMENTS 3,559,127 1/1971 Schindler ..... 335/216

4,367,372 1/1983 Kiblaire et al. ..... 335/216

*Primary Examiner*—Lincoln Donovan

*Attorney, Agent, or Firm*—Paul R. Webb, II

[57] ABSTRACT

Composite superconducting windings of the type that have superconductor wires wound with glass cloth, an array of axial insulated copper wires, copper foil straps of expanded metal or perforated foil which are positioned between winding layers to reinforce the composite winding and enhance the thermal conductivity of the winding, and an overwrap of high strength stainless steel wires to provide additional rigidity to the composite winding. Structures of this type, generally, form a self-supported, structurally robust composite winding and support structure that is capable of withstanding the hoop and axial stresses that result from the electromagnetic loads created by the superconductor.

9 Claims, 1 Drawing Sheet

SUPERCONDUCTING WINDING AND SUPPORT STRUCTURE

BACKGROUND OF THE INVENTION

1. Field of the Invention

This invention relates to superconducting composite windings of the type that have a superconductor wire wound with glass cloth and an array of axial insulated copper wires or copper foil straps of expanded metal or perforated foil which are positioned between winding layers to reinforce the composite winding and enhance the thermal conductivity of the winding. Structures of this type, generally, form a self-supported, structurally robust composite winding and support structure that is capable of withstanding the hoop and axial stresses that result from the electromagnetic loads created by the superconductor.

2. Description of the Related Art

It is known, that when superconducting windings and subjected to electromagnetic loads and thermal strains produced during the normal operation or transition of the superconductor to the normal state, that such loads or thermal strains create hoop and axial stresses in the superconducting winding which can adversely affect the superconducting characteristics of the superconducting winding. Therefore, a more advantageous winding and support structure would be presented if such a amounts of stresses could be reduced.

It is apparent from the above that there exists a need in the art for a superconducting winding and support structure which is light weight through simplicity of parts and uniqueness of structure, and which at least equals the superconducting characteristics of the known superconducting windings and support structures, but which at the same time is capable of reducing the hoop and axial stresses in the superconducting winding. It is a purpose of this invention to fulfill this and other needs in the art in a manner more apparent to the skilled artisan once given the following disclosure.

SUMMARY OF THE INVENTION

Generally speaking, this invention fulfills these needs by providing a superconducting winding and support for demountable coil form superconducting winding, comprising a superconductor wound substantially around said coil form, an insulation material located adjacent to said superconductor, an array of axial metal straps located adjacent to said insulation material, an overwrap wire substantially surrounding said superconducting winding and an epoxy-like material which substantially surrounds said superconductor, said insulation material, said array and said overwrap.

In certain preferred embodiments, the low temperature superconductor is a niobium/tin superconductor with a sintered copper stabilizer. Also, the insulation material is glass cloth. Finally, the metal straps comprise insulated copper wires, expanded copper foil straps or perforated foil.

In another preferred embodiment, the winding forms a self-supported, structurally robust composite with high thermal conductivity that is capable of withstanding the hoop and axial stresses that result from the electromagnetic loads created by the superconductive magnet, as well as, the thermal strains that result from normal transition of the superconductor.

The preferred superconducting winding, according to this invention, offers the following advantages: light weight; high thermal conductivity; easy assembly; easy fabrication into a superconducting magnet; excellent superconducting characteristics; good stability; good durability; good economy; and high strength for safety. In fact, in many of the preferred embodiments, these factors of ease of fabrication and excellent superconducting characteristics are optimized to an extent that is considerably higher than heretofore achieved in prior, known superconductive windings.

BRIEF DESCRIPTION OF THE DRAWINGS

The above and other features of the present invention which will be more apparent as the description proceeds are best understood by considering the following detailed description in conjunction with the accompanying drawings wherein like character represent like parts throughout the several veins and in which.

DETAILED DESCRIPTION OF THE INVENTION

Figures 1, 2:
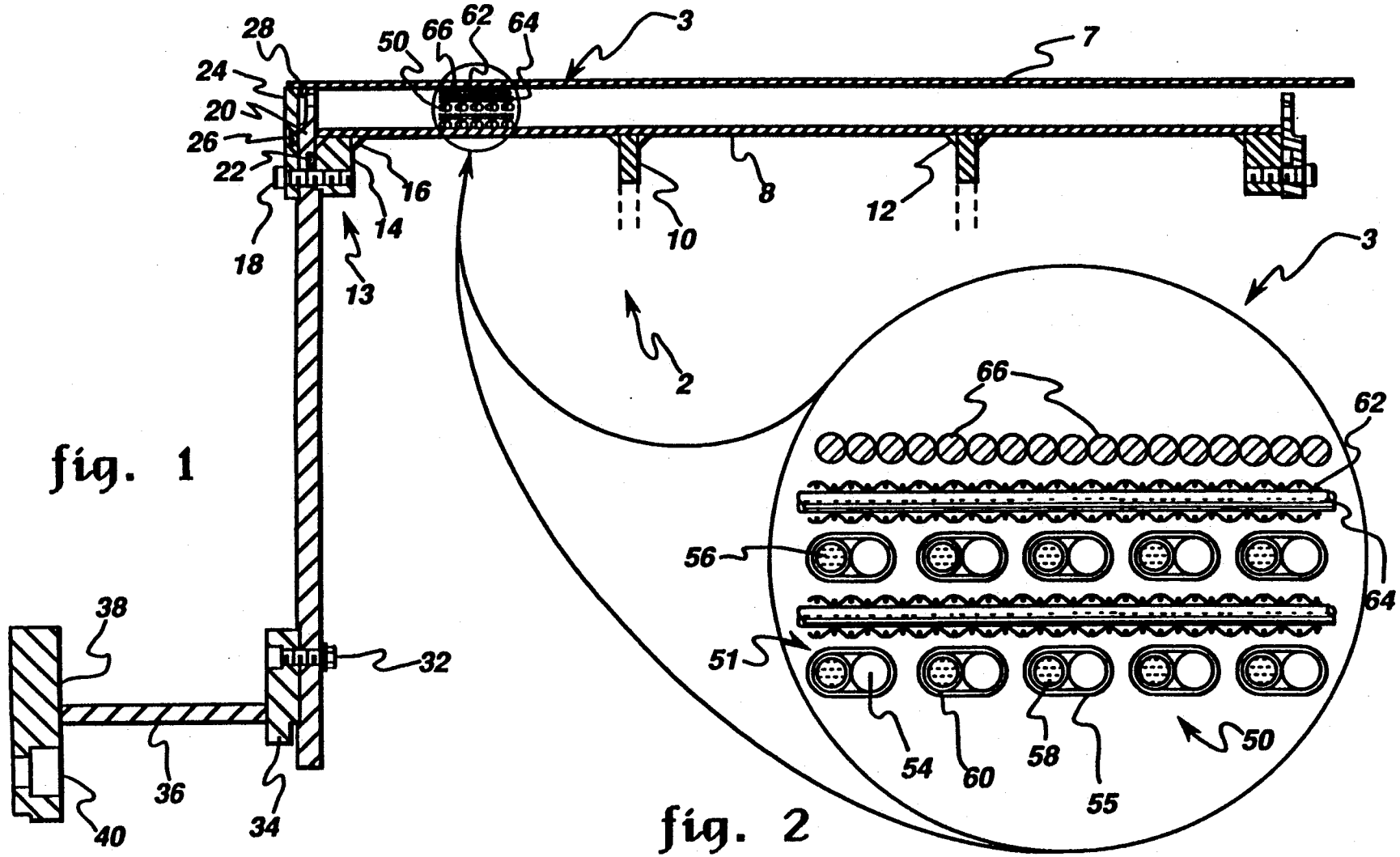
FIG. 1 is a side plan view of a superconductive winding and demountable coil form according to the present invention.
FIG. 2 is a detailed view of the superconductive winding after the parts have been epoxy impregnated, according to the present invention.

With reference first to FIG. 1, there is illustrated superconductive winding and demountable coil form 2. Winding and coil form 2 includes, in part, superconductive winding 3, impregnation pan 7, mandrel 8, mandrel support 13, epoxy inlet holes 28, support legs 20, 36, and bracket 38.

Mandrel 8, preferably, is constructed of any suitable metallic material. Supports 10 which, preferably, are constructed of any suitable metallic material are welded by conventional weldments 12 to mandrel 8. Located on mandrel 8 is superconductive winding 3. Superconductive winding 3 will be discussed in more detail later with reference to FIG. 2. A conventional impregnation pan 7 is located on top of superconductive winding 3.

Mandrel 8 is rigidly attached to leg 30 by mandrel support 13. In particular, mandrel support 13 includes conventional bracket 14 which is rigidly attached to mandrel 8 by conventional weldment 16. The conventional fastener 18 is used to attach conventional brackets 24 and 20 to bracket 14. Conventional elastomeric O-rings 22 and 26 are used to prevent epoxy from leaking out around mandrel support 13. Located on bracket 20 is an epoxy inlet hole 28. Hole 28 allows epoxy to be introduced into the area between mandrel 8 and impregnation pan 7 so that superconductive winding 3 will become impregnated with epoxy.

Connected to the other end of leg 20 is a conventional bracket 34. Bracket 34 is rigidly attached to leg 20 by a conventional fastener 32. A conventional bracket 36 is rigidly attached to brackets 34 and 38 by a conventional attachment (not shown). Located within bracket 38 is a fastener hole 40 which is used to attach bracket 38 to a conventional support stand (not shown).

With respect to FIGS. 1 and 2, there is shown a detailed illustration of superconductive winding 3. In particular, winding 3 includes composite superconductor wire 50, insulation cloth 62 and an array 64 of insulated copper wires, foil straps of expanded metal or perforated foil. Insulation cloth 62, preferably, is constructed of glass cloth. Array 64, preferably, is constructed of film insulated copper wires bonded together with varnish. As shown more clearly in FIG. 2, composite superconductor 50 includes conductor 51, stabilizer wire 54 and insulation 55. Conductor 51 includes matrix 53, filaments 56, diffusion barrier 58, and stabilizer ring 60. In particular, matrix 53, preferably is constructed of bronze. Filaments 56, preferably, are constructed of niobium. Diffusion barrier 58 is located around the circumference of matrix 53 in order to prevent tin from diffusing to ring 60. Diffusion barrier 58, preferably, is constructed of niobium. Ring 60 and stabilizer wire 54, preferably, are constructed of copper. Insulation 55 is wrapped around wires 50 and 54. Insulation 55, preferably, is constructed of filamentary glass.

In order to construct composite superconducting wire 50, conductor wire 51 is paired with wire 54. It is to be understood that wire 51 and wire 54 should be of approximately the same diameter. After wire 51 is paired with wire 54, both wires 51 and 54 are insulated with a spiral wrap of insulation 55 by conventional wrapping techniques. Insulation 55, preferably, is wrapped under tension so that wires 51 and 54 are in good contact with each other. The insulated pairs of wires 51 and 54 is wound onto a conventional stainless steel reaction spool (not shown) by conventional winding techniques. The wound spool is placed inside a conventional vacuum furnace (not shown) and is subjected to a conventional temperature/time schedule which is designed to react the niobium with the tin in order to form $Nb_3Sn$. At the reaction temperatures which, typically, are at least 600° C., the thermal expansions of wires 51 and 54 exceed that of insulation 55 so that wires 51 and 54 are forced into tighter contact with each other. The conventional vacuum atmosphere, high temperature and high contact pressure cause wires 51 and 54 to sinter with each other. As a result, the copper wire 54 is in intimate contact with conductor wire 51 in order to share current and provide additional stabilization in the event that the superconductor transitions to the normal state.

After composite superconducting wire 50 has been formed, superconductive winding 3 is formed by wrapping superconducting wire 50 around mandrel 8 by conventional wrapping techniques. A layer of insulation 62 is then wound on top of superconducting wire 50 by conventional wrapping techniques. Finally, an array 64 of insulated copper wires are wrapped around the insulation layer 62. This wrapping procedure is then repeated such that there is at least one layer of insulation between superconducting wire 50 and array 64. After superconducting winding 3 has been wound around mandrel 8 several layers of stainless steel wire 66 are wound by conventional winding techniques on the outside surface of winding 3, to provide a rigid structure for supporting the radial electromagnetic loads.

After superconducting winding 3 and stainless steel overwrap 66 has been wrapped around mandrel 8, impregnation pan 7 is placed over top of superconducting winding 3. Once impregnation pan 7 is in place, a conventional epoxy is transported by a conventional epoxy transportation means (not shown) through hole 28 in bracket 20. Winding 3 is then epoxy impregnated by convention techniques and released from mandrel 8 to form a self-supported structurally robust composite with high thermal conductivity that is capable of withstanding the hoop and axial stresses that result from the electromagnetic load created by the superconducting magnet, as well as, the thermal strains that result from the normal transition of the superconductor.

Once given the above disclosure, many other features, modification or improvements will become apparent to the skilled artisan. Such features, modifications or improvements are, therefore, considered to be a part of this invention, the scope of which is to be determined by the following claims.

What is claimed is:

1. A superconducting winding and demountable coil form for a superconducting winding, wherein said winding is comprised of:

a coil form;

at least two superconductors wound substantially on said coil form and located at a predetermined distance away from each other;

an insulation material located substantially between said superconductors;

an array of axial metal straps located substantially within said insulation material;

an overwrap wire substantially surrounding said superconductive winding, insulation and said array; and an epoxy-like material which substantially surrounds said superconductor, said insulation material, said array, and said overwrap wire.

2. The winding and demountable coil form of claim 1, wherein said demountable coil form means is further comprised of:

a mandrel; and a mandrel support means operatively connected to said mandrel.

3. The winding and demountable coil form of claim 2, wherein said mandrel support means is further comprised of:

a mandrel bracket means; and a sealing means located adjacent to said mandrel bracket means.

4. The winding and demountable coil form of claim 3, wherein said mandrel bracket means is further comprised of:

an epoxy introduction means.

5. The winding and demountable coil form of claim 1, wherein said insulation material is further comprised of:

a glass-like material.

6. The winding and demountable coil form of claim 1, wherein said array is further comprised of:

expanded copper foil straps.

7. The winding and demountable coil form of claim 1, wherein said array is further comprised of:

insulated copper wires.

8. The winding and demountable coil form, as in claim 1, wherein said overwrap wire is further comprised of:

a high strength stainless steel wire.

9. A method for producing a superconductive winding having a superconductor, an insulation material, an array of axial metal straps, an overwrap wire and an epoxy-like material, a support mandrel and an impregnation pan wherein said method is comprised of the steps of:

wrapping said superconductor around said mandrel;

wrapping said insulation substantially on top of said superconductor;

wrapping said array substantially on top of said insulation;

wrapping said overwrap wire substantially on top of said superconductive winding;

placing said impregnation pan substantially on top of said overwrap wire;

introducing said epoxy-like material onto said superconductor, said insulation, said array and said overwrap wire; and removing said support mandrel and said pan.

* * * * *